United States Patent [19]

Kühnert

[11] 4,402,196

[45] Sep. 6, 1983

[54] FLAT KNITTING MACHINE HAVING A STROKING-IN DEVICE

[75] Inventor: Gottfried Kühnert, Aalen, Fed. Rep. of Germany

[73] Assignee: Universal Maschinenfabrik Dr. Rudulf Schieber GmbH & Co. KG, Westhausen, Fed. Rep. of Germany

[21] Appl. No.: 365,925

[22] Filed: Apr. 5, 1982

[30] Foreign Application Priority Data

May 22, 1981 [DE] Fed. Rep. of Germany ..... 3120554

[51] Int. Cl.[3] ..... D04B 7/04

[52] U.S. Cl. ..... 66/64

[58] Field of Search ..... 66/64, 604, 60

[56] References Cited

U.S. PATENT DOCUMENTS 3,685,317 8/1972 Giachett et al. ..... 66/64

4,080,806 3/1978 O'Sullivan et al. ..... 66/64

*Primary Examiner*—Ronald Feldbaum

*Attorney, Agent, or Firm*—Sughrue, Mion, Zinn, Macpeak & Seas

[57] ABSTRACT

A flat knitting machine with a carriage movable over the needle beds includes stroking-in wires mounted in holders on the carriage with free wire ends trailing in the direction of carriage traverse in front of the withdrawal positions of the needles. These wires are moved into and out of their working positions at the regions where the carriage reverses its direction of movement. In order to make possible a selectively controlled switching of the stroking-in wires into and out of effective operation, indexing cams engageable with entraining fingers on the holders are arranged on the machine frame to be displaceable perpendicular to the longitudinal axes of the needle beds, and lifting cams which can be switched into and out of action are mounted on the carriage for selective displacement of the indexing cams on the machine frame.

5 Claims, 4 Drawing Figures

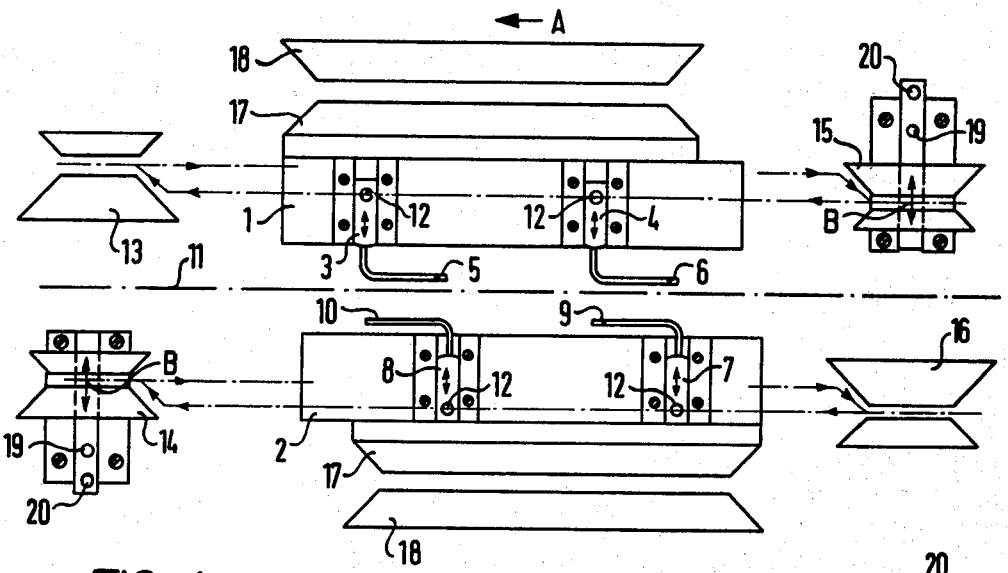
FIG. 1
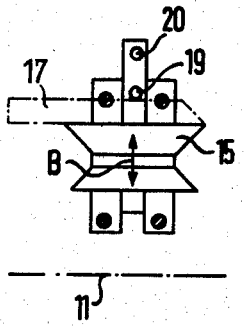
FIG. 2
FIG. 3
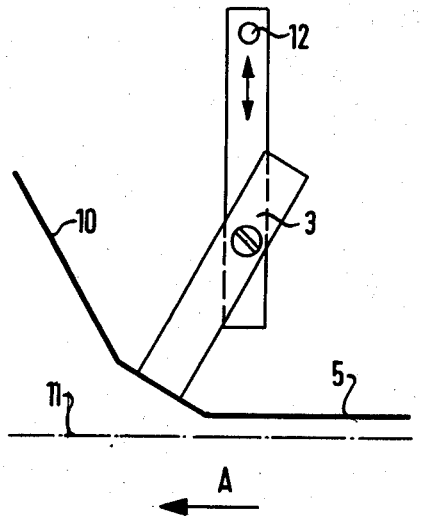
FIG. 4
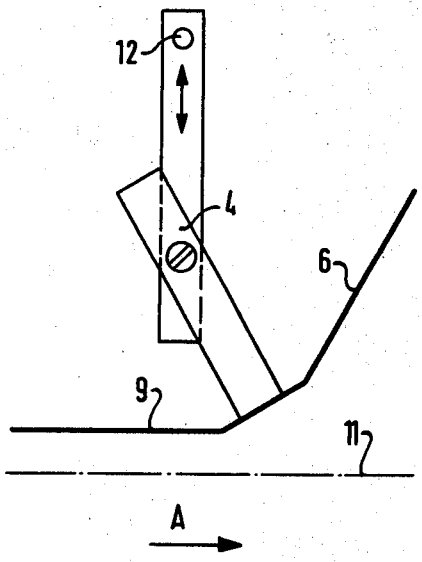

FLAT KNITTING MACHINE HAVING A STROKING-IN DEVICE

FIELD OF THE INVENTION

This invention relates to a flat knitting machine comprising a machine frame, a carriage movable over needle beds, and stroking-in wires mounted in holders on the carriage with free ends trailing in the direction of carriage traverse in front of the withdrawal positions of the needles and which are moved into and out of their working positions at the regions where the carriage reverses its direction of travel.

If thread combinations are to be produced on flat knitting machines, where the take-up device, for example in the form of take-up rollers, exerts insufficient influence, then stroking-in wires are used which hold the stitches down as the needles are being withdrawn. The withdrawal of the needles takes place during knitting, i.e. during the formation of stitches or loops, and upon transfer of the stitches.

In known flat knitting machines which have a stroking-in device the holders for the stroking-in wires are mounted on the cariage and are so arranged that they are always located in the direction of travel of the carriage in front of the withdrawal position of the needles. The stroking-in wire lies between the needle bed combs and below the needles which cross upon withdrawal. The trailing wire ends must in each case be free. This means therefore that each stroking-in wire can only be set into place for operation in one direction of travel of the carriage.

In certain known flat knitting machines, pivotable holders arranged on the carriage have therefore been used for example, which each have a stroking-in wire extending to the left and to the right and which, depending upon the direction of travel of the carriage, are pivoted automatically at the regions of carriage reversal to the left or to the right into the position beneath the crossing needles.

In other known flat knitting machines the stroking-in wires are individually mounted each on a holder which is displaceable perpendicular to the direction of carriage travel and relative to the carriage, and the wires are each switched automatically at the regions of carriage reversal into their working positions for the next direction of carriage traverse. Here again there is no possibility of carriage traverse without the stroking-in wires being moved into their working positions.

In another known stroking-in device a stroking-in wire overhangs its holder which is fastened to the carriage, and at the positions of reversal of movement of the carriage is displaced across by the holder in such a manner that it overhangs on the appropriate side and such that it is brought into the stroking-in position with a free trailing wire end. All these known stroking-in devices are secured to the carriage so that they must always be in operation.

SUMMARY OF THE INVENTION

It is an object of the present invention to provide a flat knitting machine of the type first described above in which the stroking-in devices on the carriage can be selectively switched into operation and out of operation.

This is achieved in accordance with the present invention by a flat knitting machine comprising a machine frame, a carriage movable over needle beds, and stroking-in wires mounted in holders on the carriage with free ends trailing in the direction of carriage traverse in front of the withdrawal positions of the needles, said stroking-in wires being respectively movable into and out of working positions at the positions of reversal of movement of the carriage, first cam means arranged on the machine frame at the regions of carriage movement reversal and displaceable perpendicular to the longitudinal axes of the needle beds, said first cam means being engageable with entraining projections on the holders, and second cam means on the carriage which can be switched into and out of action for selective displacement of said first cam means on the machine frame.

Certain knitted garments, for example pullovers, comprise a welt portion and a patterned body portion. The stroking-in device is needed only for the patterned body portion, and causes interference in the knitting of the welt. With the flat knitting machine of the present invention, the stroking-in devices, independent of the direction of carriage travel, permit the stroking-in wires either to move into the working positions beneath the crossing needles or to be withdrawn from these working positions, as desired. Such a selective setting up of the stroking-in devices can also be important during the knitting of a body portion, since for this the stroking-in device is used several times or not at all.

In one embodiment of flat knitting machine, with the holders for the stroking-in wires mounted pivotably on the carriage, these holders are not ony pivotable but are also mounted so as to be displaceable vertically towards the needle bed combs.

In another embodiment of the flat knitting machine, with the holders for the stroking-in wires mounted to be displaceable only vertically towards the needle bed combs, the holders for one direction of carriage traverse are mounted on a first carriage jaw and the holders for the other direction of carriage traverse are mounted on a second carriage jaw, and only those of said first cam means which are on the side of the free wire ends are displaceable. The other first cam means, i.e. indexing cams, are fixed-position cams which move the stroking-in wires out of action at the regions of carriage reversal.

Preferably, at least one switchable second cam means, i.e. lifting or override cam, is mounted on the carriage for displacement of the first cam means towards the needle bed combs, and another switchable second cam means is provided on the carriage for displacement of the first cam means away from the needle bed combs.

In a preferred arrangement two vertically movable holders are provided for each direction of carriage traverse.

BRIEF DESCRIPTION OF THE DRAWINGS

The invention is described in more detail hereinafter with reference to the embodiments shown in the accompanying drawing, in which:

FIG. 1 is a plan view of a stroking-in device in accordance with the invention where both the carriage jaws of a carriage are provided with associated lifting cams on the carriage, and where indexing cams are provided on the machine frame, with holders displaceable only vertically towards the needle bed combs;

FIG. 2 is a plan view of one of the indexing cams on the machine frame displaced into its inactivating position;

FIG. 3 shows an alternative form of holder for stroking-in wires, the holder being mounted so as to be pivotable and displaceable on the carriage and being shown in its working position; and, FIG. 4 shows the holder of FIG. 3 in its reverse pivot and raised position in which it is displaced out of its working position.

DESCRIPTION OF THE PREFERRED EMBODIMENT

The stroking-in device of a flat knitting machine shown in FIG. 1 comprises a first pair of holders 3 and 4 for two stroking-in wires 5 and 6 for use with travel of the carriage from right to left, and a second pair of holders 7 and 8 for two stroking-in wires 9 and 10 for use with travel of the carriage from left to right. The respective pairs of holders 3, 4 and 7, 8 are mounted on the rearward and forward carriage jaws 1 and 2 of the knitting machine carriage which is not shown. The holders 3, 4, 7 and 8 are secured so as to be displaceable vertically back and forth towards and away from the needle bed combs which are not shown. The middle line between the two needle beds, which are not shown, is indicated at 11. An entraining finger 12 is provided on each of the holders 3, 4, 7 and 8.

Indexing cams 13, 14, 15 and 16 are mounted on the machine frame (not shown) at the regions where the carriage undergoes a reversal of movement. These indexing cams are struck by the entraining fingers 12 as the carriage travels to the left or to the right, and thus displace the holders 3, 4, 7 and 8 into and out of working positions for the stroking-in wires 5, 6, 9 and 10. In FIG. 1, the position of the stroking-in wires for travel of the carriage from right to left in the direction of the arrow A is shown. Upon reversal of the carriage at the right-hand end, the stroking-in wires 5 and 6 are brought into their working positions by means of indexing cam 15, and the stroking-in wires 9 and 10 are moved out of their working positions by means of indexing cam 16. Upon reversal of the carriage at the left-hand end the stroking-in wires 5 and 6 are moved out of their working positions by means of indexing cam 13, and the stroking-in wires 9 and 10 are moved into their working position, into the positions shown in FIG. 1, by means of indexing cam 14.

Indexing cams 13 and 16 are fixed-position cams which always move the appropriate stroking-in wires out of their working positions. Indexing cams 14 and 15 on the other hand are mounted on the machine frame so as to be displaceable in the direction of the double-headed arrows B. In the arrangement shown in FIG. 1 these indexing cams 14 and 15 always move the associated stroking-in wires into their working positions.

Lifting cams 17 and 18 which function as override cams and which can be switched into and out of action are fitted on each of the carriage jaws 1 and 2. Lifting cams 17 displace the indexing cams 14 and 15 on the machine frame by means of an entraining finger 19 on these indexing cams at the positions of carriage movement reversal, into positions in which these indexing cams 14, 15 move the associated stroking-in wires out of their working positions. Lifting cams 18 in an equivalent manner displace the indexing cams 14 and 15 by means of entraining fingers 20 on the latter into positions in which these indexing cams 14, 15 move the associated stroking-in wires into their working positions. By selective control of the switchable lifting cams 17 and 18 on the carriage one can thus determine at will whether the stroking-in wires which have been prepared ready for work should be switched into operation or out of operation for the next carriage traverse.

FIG. 2 shows indexing cam 15 in a position where it has been upwardly displaced by the lifting cam 17 and in which it moves the associated stroking-in wires 5 and 6 out of their working positions for the next carriage traverse in the direction of the arrow A in FIG. 1, in contrast to the position shown in FIG. 1.

FIGS. 3 and 4 show an embodiment of holder in which the stroking-in wires 5 and 10 on the one hand and the stroking-in wires 6 and 9 on the other hand are respectively mounted on common pivotable holders 3 and 4. The holders 3 and 4 are pivotable in order to move the stroking-in wires into and out of their working positions at the regions of carriage movement reversal. Additionally, the holders 3 and 4 are displaceable vertically towards the centre-line 11 between the needle beds in the direction of the double-headed arrow B. This is achieved with the aid of the displaceable indexing cam 15 at the right-hand end carriage reversal and with the aid of an indexing cam 13, which is here likewise displaceable and corresponds in its construction to indexing cam 15 at the left-hand end position of carriage reversal. The control of the lifting cams 17 and 18 on the carriage is effected as described above in connection with FIG. 1.

The construction of the stroking-in device of a flat knitting machine according to the invention makes it possible selectively to move the stroking-in wires out of their working positions, even if these have been or are to be switched into action in dependence upon the direction of carriage traverse. A corresponding adaptation of the device to flat knitting machines with circular carriages can be achieved without difficulty from the details already given above, and will not therefore be described in detail.

I claim:

1. A flat knitting machine comprising a machine frame, a carriage movable over needle beds, and stroking-in wires mounted in holders on the carriage with free ends trailing in the direction of carriage traverse in front of the withdrawal positions of the needles, said stroking-in wires being respectively movable into and out of working positions at the positions of reversal of movement of the carriage, first cam means arranged on the machine frame at the regions of carriage movement reversal and displaceable perpendicular to the longitudinal axes of the needle beds, said first cam means being engageable with entraining projections on the holders, and second cam means on the carriage which can be switched into and out of action for selective displacement of said first cam means on the machine frame.

2. A flat knitting machine as claimed in claim 1, in which the holders for the stroking-in wires are mounted pivotably on the carriage and are also displaceable vertically towards the needle bed combs.

3. A flat knitting machine as claimed in claim 1, in which the holders for the stroking-in wires are mounted to be displaceable vertically towards the needle bed combs, in which the holders for one direction of carriage traverse are mounted on a first carriage jaw and the holders for the other direction of carriage traverse are mounted on a second carriage jaw, and in which only those of said first cam means which are on the side of the free wire ends are displaceable.

4. A flat knitting machine as claimed in claim 1, 2 or 3 in which at least one switchable second cam means is mounted on the carriage for displacement of the first cam means towards the needle bed combs, and another switchable second cam means is mounted on the carriage for displacement of the first cam means away from the needle bed combs.

5. A flat knitting machine as claimed in claim 1, 2, 3 or 4 in which two vertically displaceable holders are provided for each direction of carriage traverse.

* * * * *